US010239595B2

(12) United States Patent
Yang et al.

(10) Patent No.: US 10,239,595 B2
(45) Date of Patent: Mar. 26, 2019

(54) AUTOMATICALLY ARRANGED EMERGENCY SHIPWRECK POSITION-INDICATING BUOY

(71) Applicants: Qingyong Yang, Qingdao (CN); Lingling Xu, Qingdao (CN)

(72) Inventors: Qingyong Yang, Qingdao (CN); Lingling Xu, Qingdao (CN)

( * ) Notice: Subject to any disclaimer, the term of this patent is extended or adjusted under 35 U.S.C. 154(b) by 0 days.

(21) Appl. No.: 15/779,078

(22) PCT Filed: Nov. 22, 2016

(86) PCT No.: PCT/CN2016/106716
§ 371 (c)(1),
(2) Date: May 24, 2018

(87) PCT Pub. No.: WO2017/088726
PCT Pub. Date: Jun. 1, 2017

(65) Prior Publication Data

US 2018/0354595 A1 Dec. 13, 2018

(30) Foreign Application Priority Data

Nov. 25, 2015 (CN) ..... 2015 2 0950980 U

(51) Int. Cl.
*B63C 7/26* (2006.01)

(52) U.S. Cl.
CPC ..... *B63C 7/26* (2013.01)

(58) Field of Classification Search
CPC ..... B63C 7/26
(Continued)

(56) References Cited

U.S. PATENT DOCUMENTS 2,830,309 A * 4/1958 Lawson ..... B63B 22/22 116/210
3,123,842 A * 3/1964 Oeland, Jr. ..... B63B 22/12 116/210

(Continued)

FOREIGN PATENT DOCUMENTS

CN 102514695 A 6/2012
CN 103950521 A 7/2014

(Continued)

OTHER PUBLICATIONS

The extended European Search Report of corresponding European application No. 16867949.1-1015/3366569, dated Sep. 26, 2018.

(Continued)

*Primary Examiner* — Anthony D Wiest
(74) *Attorney, Agent, or Firm* — J.C. Patents

(57) ABSTRACT

The present application relates an automatically arranged emergency shipwreck position-indicating buoy, which belongs to the technical field of navigation (ship) aids. The automatically arranged emergency shipwreck position-indicating buoy comprises a gasbag, a rope, a high-pressure gas storage device, and a position-indicating light assembly; a rear end of the rope is wound onto a shaft arranged on the gasbag and a front end of the rope is arranged on a ship; a gas outlet of the high-pressure gas storage device is communicated with a gas inlet of the gasbag, and a sealing device is arranged at the gas outlet of the high-pressure gas storage device, and the sealing device is connected to the rope by a connector so as to be arranged on the ship; the position-indicating light assembly is arranged above the gasbag. The present application can be automatically arranged when a ship sinks, and the position of the position-indicating buoy changes as the position of the shipwreck changes in order to indicate the position of the shipwreck (Continued)

and provide convenience for passing ships and shipwreck operation.

18 Claims, 4 Drawing Sheets

(58) Field of Classification Search
USPC ..... 441/9, 30
See application file for complete search history.

(56) References Cited

U.S. PATENT DOCUMENTS 3,341,871 A * 9/1967 Oliveau ..... B63B 22/14
244/139
3,613,616 A * 10/1971 Basset ..... B63C 7/06
114/328
3,618,150 A * 11/1971 Anselmi ..... B63B 22/08
441/16
4,721,486 A * 1/1988 Goettel ..... B63C 7/26
251/294
4,784,626 A * 11/1988 DeLaro ..... B63C 7/26
441/7
6,032,607 A 3/2000 Ashline ..... 116/210

FOREIGN PATENT DOCUMENTS

| | | | |
|---|---|---|---|
| CN | 205221033 | U | 5/2016 |
| FR | 2 447 729 | A | 8/1980 |
| KR | 2004-0027306 | A | 4/2004 |
| KR | 2005-0013463 | A | 2/2005 |
| KR | 2010-0096767 | A | 9/2010 |
| KR | 2011-0117611 | A | 10/2011 |
| WO | WO 2004/014724 | A1 | 2/2004 |

OTHER PUBLICATIONS

The International Search Report of corresponding International PCT Application No. PCT/CN2016/106716, dated Feb. 7, 2017.

* cited by examiner

AUTOMATICALLY ARRANGED EMERGENCY SHIPWRECK POSITION-INDICATING BUOY

CROSS-REFERENCE TO RELATED APPLICATION

This application is a national phase application of international application No. PCT/CN2016/106716 filed on Nov. 22, 2016, which in turn claims the priority benefits of Chinese application No. 201520950980.1, filed on Nov. 25, 2015. The contents of these prior applications are hereby incorporated by reference in their entirety.

TECHNICAL FIELD

The present application belongs to the technical field of navigation (ship) aids and relates to a shipwreck position-indicating buoy and in particular to an automatically arranged emergency shipwreck position-indicating buoy.

BACKGROUND

Shipwrecking happens due to the complexity and unpredictability at sea. After a ship sinks in an accident, it is usually unable to refloat or remove the sunken ship immediately as a result of many factors such as technical and weather conditions. Those shipwrecks are usually in or near the navigation routes, resulting in serious navigational dangers for passing ships. Therefore, it is necessary for the competent authorities responsible for navigational beacons and buoys to arrange shipwreck position-indicating buoys immediately after a ship sinks and poses navigational danger to passing ships.

The traditional shipwreck position-indicating buoys are a kind of buoys that have to be arranged by special buoy vessels due to their large volume and large mass, thus the arrangement thereof is difficult. In addition, the traditional shipwreck position-indicating buoys also have the following problems that are difficult to solve:

1. it takes time to complete all processes, from the dispatching of buoy vessels and shipwreck position-indicating buoy vessels by competent authorities to their arrival at the scene of shipwreck, and during this period of time, it is highly possible that secondary accidents take place when passing ships run into the shipwreck if the water depth is not enough at the position of the shipwreck; 2. since shipwrecking usually happens in bad weather conditions, it is difficult to determine the position of the shipwreck at the boundless sea; 3. even if the position of the shipwreck can be determined quickly by competent authorities, the arrangement of buoys may be inevitably influenced by the bad weather conditions; and 4. in case of any shipwreck removal, the position of the shipwreck cannot be indicated accurately by the arranged shipwreck buoy, and consequently, secondary accidents may take place.

SUMMARY

In view of the existing disadvantages mentioned above, an objective of the present application is to provide an emergency shipwreck position-indicating buoy which is, free of manual arrangement, arranged on a ship and can be automatically arranged when shipwrecking happens.

The present application employs the following technical solutions. An automatically arranged emergency shipwreck position-indicating buoy (position-indicating buoy, for short) is provided, which is arranged on a ship, comprising a gasbag, a rope, a high-pressure gas storage device, and a position-indicating lamp assembly; the rope has a certain length, a rear end of the rope is wound onto a shaft arranged on the gasbag and a front end of the rope is arranged on a ship; a gas outlet of the high-pressure gas storage device is communicated with a gas inlet of the gasbag, and a sealing device is arranged at the gas outlet of the high-pressure gas storage device to avoid, in normal situations, a leakage of high-pressure gas from the high-pressure gas storage device, the sealing device is connected to the rope by a connector so as to be connected to the ship. The position-indicating lamp assembly is arranged above the gasbag.

The present application has following beneficial effects.

(1) The emergency shipwreck position-indicating buoy is automatically arranged when a ship sinks, in order to alert passing ships in a timely and conspicuous manner, and there is no need for manual location of the position of the sunken ship and the manual arrangement of the buoy. Compared with the traditional method, the arrangement is timely, quick and convenient, and the emergency shipwreck position-indicating buoy can be recycled and reused.

(2) Since the shipwreck position-indicating buoy is connected to the shipwreck, the position of the position-indicating buoy changes as the position of the shipwreck changes due to factors such as ocean currents. Such a shipwreck position-indicating buoy is dynamic and the accuracy will not be influenced by the change of the position of the shipwreck.

(3) The position-indicating buoy in the present application can be applied not only to the shipwreck position-indicating in oceans, but also to shipwreck position-indicating in lakes or rivers.

BRIEF DESCRIPTION OF THE DRAWINGS

FIG. 5 is a schematic structural diagram of the sealing device after its opening, in which:

Figure 1:
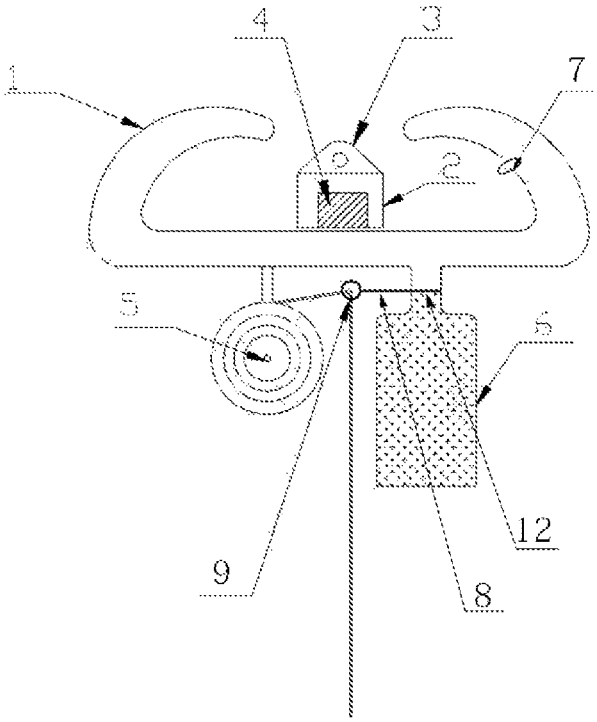
FIG. 1 is a schematic structural diagram of a position-indicating buoy before its arrangement.

1: gasbag;
2: lampstand;
3: position-indicating lamp;
4: energy storage battery;
5: rope;
6: high-pressure gas storage device;
7: exhaust valve;
8: connector;
9: locking ring;
10: fracture zone;
11: opening;
12: sealing device;
13: stopping spacer;
14: deforming spacer; and
15: baffle plate.

DETAILED DESCRIPTION

An automatically arranged emergency shipwreck position-indicating buoy, which is arranged on a ship, comprises a gasbag, a rope, a high-pressure gas storage device, and a position-indicating light assembly; the rope has a certain length, and a rear end of the rope is wound onto a shaft arranged on the gasbag and a front end of the rope is arranged on a ship; a gas outlet of the high-pressure gas storage device is communicated with a gas inlet of the gasbag, and a sealing device is arranged at the gas outlet of the high-pressure gas storage device to avoid, in normal situations, a leakage of high-pressure gas from the high-pressure gas storage device, the sealing device is connected to the rope by a connector so as to be connected to the ship. The position-indicating light assembly is arranged above the gasbag.

The expression "the rope has a certain length" means that the rope is required to have a certain length, and the certain length is determined by a general depth of waters in which the ship travels. A long length of the rope is needed for deep waters while a short length of the rope is needed for shallow waters to ensure that the gasbag can float on the water after the ship sinks.

Preferably, the sealing device is connected to a locking ring, and the front end of the rope is passed through the locking ring and then connected to the ship. Specifically, the sealing device is connected to the locking ring by the connector.

As an implementation, as the sealing device, for example, a conventional sealing device used in inflatable life rafts may be used. After the connector is triggered, the connector pulls the sealing device and the sealing device is thus opened, so that gas in the high-pressure gas storage device enters the gasbag. Furthermore, since the connector is arranged on the ship, the connector is then separated from the sealing device.

As a second implementation, as the sealing device, for example, a high-pressure tank valve structure may be used. In this case, the connector toggles the valve and the sealing device is thus opened. Then, the connector is separated from the valve.

As a third implementation, the sealing device comprises a baffle plate, a stopping spacer and deforming spacers; the baffle plate is extended from an opening of the high-pressure gas storage device to be connected to the connector, and the baffle plate is fitted with the opening; the stopping spacer is arranged at a front end of the baffle plate and the deforming spacers are respectively arranged on two sides of the baffle plate.

The stopping spacer is made of material which is harder than that of the deforming spacers. This can prevent the baffle plate from separating from the opening and further avoid the leakage of gas or backward flow of water. Therefore, it may be designed that the stopping spacer has a width greater than that of the opening, and/or has a thickness greater than a height of the opening. The deforming spacers may be made of rubber or material which is fragile under a pulling force. In this way, the deforming spacers will deform under force, so that part or all of the deforming spacers will be separated from the baffle plate, or the deforming spacers will get broken.

Further, a fracture zone is arranged between the baffle plate and the connector, and the fracture zone can withstand the pulling force during deformation of the deforming spacers, but can not withstand a stopping force exerted onto the baffle plate by the stopping spacer. When the fracture zone is subjected to the pulling force from the connector, the baffle plate can be pulled to move outward so that the sealing device opens. When the baffle plate is pulled continuously and the movement of the baffle plate is stopped by the stopping spacer, the fracture zone automatically breaks due to excessive force, so that the connector is separated from the baffle plate and the baffle plate remains in the opening of the high-pressure gas storage device. In this way, the opening is prevented from being exposed to water or gas to result in the leakage of gas or the backward flow of an external medium.

Further, a sealing member, for example, a sealing ring, is arranged between the baffle plate and the opening, by which the backward flow of water into the high-pressure gas storage device or the leakage of gas from the high-pressure gas storage device can be better avoided.

Preferably, the position-indicating lamp assembly comprises a lampstand, a position-indicating lamp arranged above the lampstand and an energy storage battery, and the energy storage battery is connected to the position-indicating lamp.

Preferably, the energy storage battery is a solar energy storage battery.

Preferably, a cross-section of the gasbag after being inflated is a trapezoid, and the position-indicating lamp assembly is arranged on an upper end surface of the trapezoid, and the rope and the high-pressure gas storage device are arranged on a lower end surface of the trapezoid. An area of the lower end surface of the gasbag is greater than that of the upper end surface.

Preferably, the rope is provided with a scale and a value of the scale where the rope is connected to the ship is 0. The rope can measure a distance between the gasbag and the ship, i.e., the shipwreck depth.

Preferably, the shaft on which the rope is wound is a revolving shaft, and the revolving shaft has a revolving force less than a buoyancy of the gasbag. Therefore, when the rope is not used, the rope can be well wound on the revolving shaft, and when the rope is used, the rope is unwound with a relative rising movement of the gasbag.

Further, the automatically arranged emergency shipwreck position-indicating buoys may be used in pairs, comprising a bow position-indicating buoy and a stern position-indicating buoy. The position-indicating lamps respectively on the bow position-indicating buoy and on the stern position-indicating buoy are different in color, and the gasbags respectively on the bow position-indicating buoy and on the stern position-indicating buoy are also different in color. The use of position-indicating lamps (buoy indicators) of different colors on the bow position-indicating buoy and the stern position-indicating buoy can indicate the rough positions of a fore part and a aft part of the ship, so that operators can determine the positions of the bow and the stern according to the colors of the position-indicating lamps (buoy indicators).

Further, an exhaust valve, which can be connected with an exhaust pump, is arranged on the gasbag. It is convenient for exhaustion and recovery of gas after use (or safety inspection test).

The principle of the present application is described below. When a ship sinks, one end of the rope is pulled downward, and the locking ring is pulled by the rope. Due to the heavy weight of the ship, a huge pulling force drives the locking ring to pull the connector. Therefore, the sealing device of the high-pressure gas storage device is opened, and high-pressure gas enters the gasbag from the gas outlet quickly. Thus, the gasbag is inflated and then floats on the water. A circuit between the position-indicating lamp and the energy storage battery is turned on, and the position-indicating lamp lights. Therefore, the position of the shipwreck can be determined according to the position-indicating lamp (or buoy).

To facilitate the understanding of the technical solutions of the present application, the present application will be explained in detail below by embodiments. However, the protection scope of the present application is not limited to the solutions described in the embodiments, and any combination of other feasible technical solutions is also possible in the present application.

Embodiment 1

Figure 2:
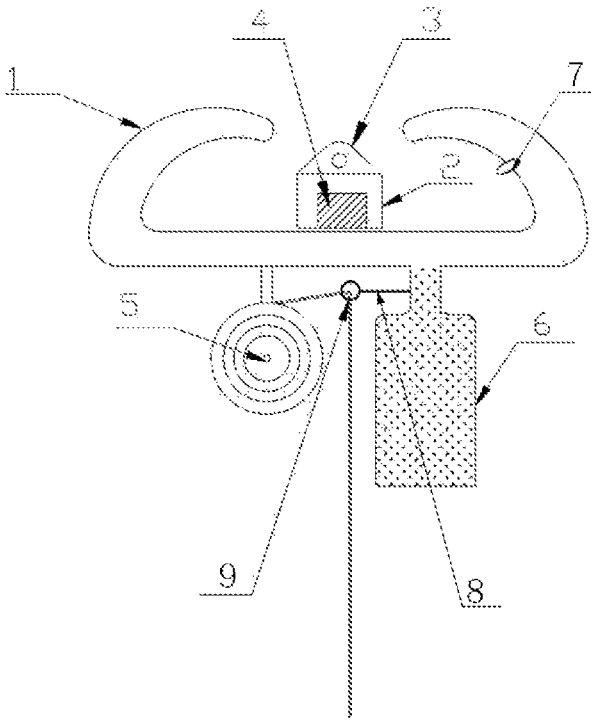
FIG. 2 is a schematic structural diagram of the position-indicating buoy during its arrangement.
Figure 3:
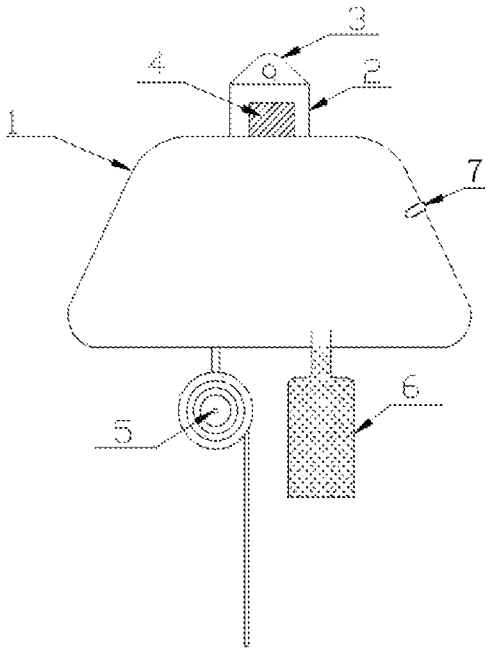
FIG. 3 is a schematic structural diagram of the position-indicating buoy after its arrangement.

As shown in FIGS. 1-3, an automatically arranged shipwreck position-indicating buoy which is arranged on a ship comprises a gasbag 1, a rope 5, a high-pressure gas storage device 6, and a position-indicating lamp assembly. The rope 5 has a certain length and is wound onto a shaft arranged on the gasbag. A gas outlet of the high-pressure gas storage device 6 is communicated with a gas inlet of the gasbag 1. A sealing device 12 is arranged at the gas outlet of the high-pressure gas storage device 6 and is connected to a locking ring 9 from which a front end of the rope 5 is passed. The high-pressure gas storage device 6 and the rope 5 are arranged below the gasbag, and the position-indicating lamp assembly is arranged above the gasbag 1. An exhaust valve 7 is arranged on the gasbag 1.

An overall density of the automatically arranged shipwreck position-indicating buoy is less than that of water, so that it can be arranged by means of buoyancy.

The position-indicating lamp assembly comprises a lampstand 2, a position-indicating lamp 3 arranged above the lampstand 2, and an energy storage battery 4 which is connected to the position-indicating lamp 3 to provide energy to the position-indicating lamp 3. To ensure that the position-indicating lamp 3 can light in a long period of time, a solar energy storage battery can be used as the energy storage battery 4.

A cross-section of the gasbag after being inflated is a trapezoid. The position-indicating lamp assembly is arranged on an upper end surface of the trapezoid, and the rope 5 and the high-pressure gas storage device 6 are arranged on a lower end surface of the trapezoid. An area of the lower end surface of the gasbag is greater than that of the upper end surface. Compared with a square structure, the trapezoidal structure provides more stable floating effect.

The automatically arranged emergency shipwreck position-indicating buoys may be used in pairs, comprising a bow position-indicating buoy arranged on a bow and a stern position-indicating buoy arranged on a stern, the structures of which are the same. The position-indicating lamps 3 respectively on the bow position-indicating buoy and on the stern position-indicating buoy are different in color, and the gasbags respectively on the bow position-indicating buoy and on the stern position-indicating buoy are also different in color. In this way, the positions of the bow and the stern can be distinguished in the day time and at night. For example, the bow position-indicating buoy may be set in red, and the stern position-indicating buoy may be set in green, for the purpose of distinguishing them. Of course, other different colors may be used as long as the distinguishing effect can be realized.

The rope 5 is a high-strength anticorrosive rope. The rope 5 is provided with a scale on the rope body, and a value of the scale where the rope is connected to the ship is 0. A value of the scale where the rope is wound on the tail end of the shaft is a maximum value of the scale on the rope body. The length of the rope 5 may be chosen as needed, as long as a conventional traveling depth can be measured. For an extreme case where a ship sinks down to hundreds of meters of water, generally, it is not considered in the present application since this shipwreck will not result in the risk of secondary collision for passing ships and it is difficult to refloat the shipwreck. Actually, if it is possible to use the present buoy, the present application can be also recommended.

When a ship sinks, the ship drags one end of the rope 5 to sink together. The dragging on the rope 5 exerts a huge pulling force onto the locking ring 9, so that the locking ring 9 moves laterally relative to the opening of the high-pressure gas storage device 6, the gas outlet is opened, and the high-pressure gas enters the gasbag 1. Meanwhile, the rope 5 also drags down an insulating spacer connected to a switch between the position-indicating lamp 3 and the energy storage battery 4, so that the circuit between the energy storage battery 4 and the position-indicating lamp 3 is turned on, and the position-indicating lamp 3 lights.

The inflated gasbag has greater buoyancy and will float on the water instead of sinking together with the ship. The value of scale on the rope 5 above the surface of water indicates the depth of the shipwreck. The rescuers determine the position of the shipwreck according to the indication of the shipwreck position-indicating buoy (position-indicating lamps 3) to start the rescue, shipwreck disposal and other operations.

At end of the shipwreck disposal, after the traditional shipwreck position-indicating buoys are arranged, the exhaust valve 7 is connected to an exhaust pump to exhaust gas from the gasbag 1. Then, the gasbag is recovered.

Embodiment 2

To simplify the structure of the automatically arranged emergency shipwreck position-indicating system, only one position-indicating buoy can be arranged on the ship and can be arranged on the bow or on the stern or another proper position. Such a structure is simple. However, it has a disadvantage that only a rough position of the shipwreck can be indicated, and the positions of the bow and the stern cannot be accurately indicated.

Embodiment 3

Figure 4:
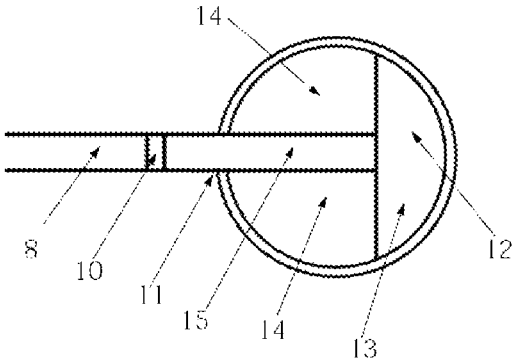
FIG. 4 is a schematic structural diagram of a sealing device before its opening.
Figure 5:
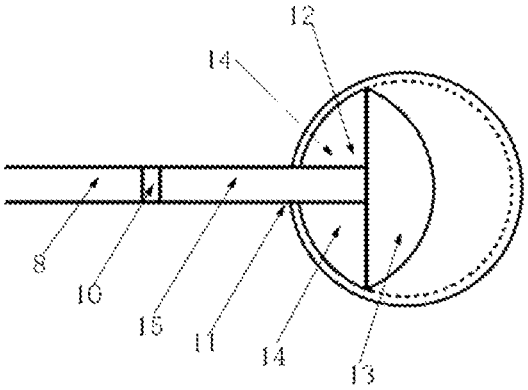

Based on Embodiment 1 or 2, FIGS. 4 and 5 are top views of the sealing device of FIG. 1. In those drawings, only the arrangement of the sealing device 12 in the high-pressure gas storage device 6 and its connection to the connector 8 are shown, and other components are omitted. Furthermore, for ease of understanding the working principle and structure of the sealing device 12, an edge of the sealing device and a wall of the high-pressure gas storage device are shown to be separated from each other (they are indicated by the two circles in FIGS. 4 and 5, wherein a circumference of an inner circle represents the edge of the sealing device and a circumference of an outer circle represents the wall of the high-pressure gas storage device). Actually, the edge of the sealing device and the wall of the high-pressure gas storage device are closely fitted. Before the sealing device 12 is opened, no leakage of high-pressure gas happens.

The sealing device 12 in this embodiment comprises a baffle plate 15. The baffle plate 15 is extended from the opening 11 of the high-pressure gas storage device to be connected to the connector 8, and a sealing ring (not shown) is arranged between the baffle plate 15 and the opening 11. A stopping spacer 13 is arranged at a front end of the baffle plate and deforming spacers 14 are respectively arranged on two sides of the baffle plate. Both the stopping spacer 13 and the deforming spacers 14 are fitted with the wall of the high-pressure gas storage device. A fracture zone 10 is arranged between the baffle plate 15 and the connector 8.

The working principle of Embodiment 3 is described below. When a ship sinks, the ship pulls one end of the rope 5 to move downward. The rope 5 pulls the locking ring 9, the locking ring 9 further pulls the connector 8, and the connector 8 pulls the baffle plate 15. The sealing device 12 moves toward the opening 11 of the high-pressure gas storage device because of the pulling of the baffle plate 15. The sealing device 12 is opened (as shown in FIG. 5), and the high-pressure gas enters the gasbag 1 from the gas outlet. A further movement of the baffle plate 15 toward the opening 11 is limited by the stopping spacer 13. When the pulling force increases continuously, the fracture zone 10 between the connector 8 and the baffle plate 15 gets broken. Now, the floating gasbag 1 is restricted only by the rope 5.

The above embodiments are merely preferred implementations of the present application and not intended to limit the scope of the present application. Various transformations and improvements made to the technical solutions of the present application by a person having ordinary skills in the art without departing from the design spirit of the present application shall fall into the protection scope defined by the claims of the present application. Meanwhile, the numerical references as used in the present application are merely provided to help a person having ordinary skills in the art to understand the technical solutions of the present application, and have no any limitation to the protection scope of the present application.

The invention claimed is:

1. An automatically arranged emergency shipwreck position-indicating buoy comprising: a gasbag (1), a rope (5), a high-pressure gas storage device (6), and a position-indicating light assembly; the rope (5) has a certain length, and a rear end of the rope is wound onto a shaft arranged on the gasbag (1) and a front end of the rope is arranged on a ship; a gas outlet of the high-pressure gas storage device is communicated with a gas inlet of the gasbag, and a sealing device (12) is arranged at the gas outlet of the high-pressure gas storage device, the sealing device (12) is connected to the rope (5) by a connector (8) so as to be connected to the ship, the sealing device (12) comprises a baffle plate (15), a stopping spacer (13) and deforming spacers (14); the baffle plate (15) is extended from an opening (11) of the high-pressure gas storage device to be connected to the connector (8), and the baffle plate (15) is fitted with the opening (11), the stopping spacer (13) is arranged at a front end of the baffle plate and the deforming spacers (14) are respectively arranged on two sides of the baffle plate; the position-indicating light assembly is arranged above the gasbag (1).

2. The automatically arranged emergency shipwreck position-indicating buoy according to claim 1, wherein, the sealing device (12) is connected to a locking ring (9), and the front end of the rope is passed through the locking ring (9) and then connected to the ship.

3. The automatically arranged emergency shipwreck position-indicating buoy according to claim 2, wherein, the position-indicating lamp assembly comprises a lampstand (2), a position-indicating lamp (3) arranged above the lampstand and an energy storage battery (4), the energy storage battery 4 is connected to the position-indicating lamp (3).

4. The automatically arranged emergency shipwreck position-indicating buoy according to claim 2, wherein, a cross-section of the gasbag after being inflated is a trapezoid, and the position-indicating lamp assembly is arranged on an upper end surface of the trapezoid, and the rope (5) and the high-pressure gas storage device (6) are arranged on a lower end surface of the trapezoid.

5. The automatically arranged emergency shipwreck position-indicating buoy according to claim 2, wherein, the rope (5) is provided with a scale and a value of the scale where the rope is connected to the ship is 0.

6. The automatically arranged emergency shipwreck position-indicating buoy according to claim 2, wherein, the shaft on which the rope (5) is wound is a revolving shaft, and the revolving shaft has a revolving force less than a buoyancy of the gasbag (1).

7. The automatically arranged emergency shipwreck position-indicating buoy according to claim 2, wherein, the buoys are used in pairs, comprising a bow position-indicating buoy and a stern position-indicating buoy; the position-indicating lamps (3) respectively on the bow position-indicating buoy and on the stern position-indicating buoy are different in color, and the gasbags (1) respectively on the bow position-indicating buoy and on the stern position-indicating buoy are also different in color.

8. The automatically arranged emergency shipwreck position-indicating buoy according to claim 1, wherein, a fracture zone (10) is arranged between the baffle plate (15) and the connector (8), and the fracture zone (10) can withstand a pulling force during deformation of the deforming spacers (14), but can not withstand a stopping force exerted onto the baffle plate (15) by the stopping spacer (13).

9. The automatically arranged emergency shipwreck position-indicating buoy according to claim 8, wherein, the position-indicating lamp assembly comprises a lampstand (2), a position-indicating lamp (3) arranged above the lampstand and an energy storage battery (4), the energy storage battery 4 is connected to the position-indicating lamp (3).

10. The automatically arranged emergency shipwreck position-indicating buoy according to claim 8, wherein, a cross-section of the gasbag after being inflated is a trapezoid, and the position-indicating lamp assembly is arranged on an upper end surface of the trapezoid, and the rope (5) and the high-pressure gas storage device (6) are arranged on a lower end surface of the trapezoid.

11. The automatically arranged emergency shipwreck position-indicating buoy according to claim 8, wherein, the shaft on which the rope (5) is wound is a revolving shaft, and the revolving shaft has a revolving force less than a buoyancy of the gasbag (1).

12. The automatically arranged emergency shipwreck position-indicating buoy according to claim 8, wherein, the buoys are used in pairs, comprising a bow position-indicating buoy and a stern position-indicating buoy; the position-indicating lamps (3) respectively on the bow position-indicating buoy and on the stern position-indicating buoy are different in color, and the gasbags (1) respectively on the bow position-indicating buoy and on the stern position-indicating buoy are also different in color.

13. The automatically arranged emergency shipwreck position-indicating buoy according to claim 1, wherein, the position-indicating lamp assembly comprises a lampstand (2), a position-indicating lamp (3) arranged above the lampstand and an energy storage battery (4), the energy storage battery 4 is connected to the position-indicating lamp (3).

14. The automatically arranged emergency shipwreck position-indicating buoy according to claim 1, wherein, a cross-section of the gasbag after being inflated is a trapezoid, and the position-indicating lamp assembly is arranged on an upper end surface of the trapezoid, and the rope (5) and the high-pressure gas storage device (6) are arranged on a lower end surface of the trapezoid.

15. The automatically arranged emergency shipwreck position-indicating buoy according to claim 1, wherein, the rope (5) is provided with a scale and a value of the scale where the rope is connected to the ship is 0.

16. The automatically arranged emergency shipwreck position-indicating buoy according to claim 1, wherein, the shaft on which the rope (5) is wound is a revolving shaft, and the revolving shaft has a revolving force less than a buoyancy of the gasbag (1).

17. The automatically arranged emergency shipwreck position-indicating buoy according to claim 1, wherein, an exhaust valve (7) is arranged on the gasbag (1).

18. The automatically arranged emergency shipwreck position-indicating buoy according to claim 1, wherein, the buoys are used in pairs, comprising a bow position-indicating buoy and a stern position-indicating buoy; the position-indicating lamps (3) respectively on the bow position-indicating buoy and on the stern position-indicating buoy are different in color, and the gasbags (1) respectively on the bow position-indicating buoy and on the stern position-indicating buoy are also different in color.

* * * * *